US006325634B1

(12) United States Patent
Daoud et al.

(10) Patent No.: US 6,325,634 B1
(45) Date of Patent: Dec. 4, 2001

(54) PANEL FOR PLUG-IN PROTECTORS

(75) Inventors: Bassel Hage Daoud, Morris County; Christopher M. Helmstetter, Somerset County; Mikhail Sumetskiy, Union County, all of NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/495,994

(22) Filed: Feb. 1, 2000

(51) Int. Cl.[7] ..... H01R 29/00
(52) U.S. Cl. ..... 439/49; 437/954
(58) Field of Search ..... 439/954, 49, 50, 439/650

(56) References Cited

U.S. PATENT DOCUMENTS 4,678,251 * 7/1987 Willard ..... 439/49
5,721,396 * 2/1998 Daoud ..... 361/622
5,848,915 * 12/1998 Canizales ..... 439/954

* cited by examiner

*Primary Examiner*—Renee Luebke
*Assistant Examiner*—Briggitte R. Hammond
(74) *Attorney, Agent, or Firm*—Howard C. Miskin; Gloria Tsui-Yip

(57) ABSTRACT

An improved panel for plug-in protectors, particularly protectors in high frequency applications. The panel comprises a plurality of five-pin sockets, each five-pin sockets corresponds to the terminals of a five-pin plug-in protector. The plurality of sockets are arranged in a staggered, brick layering configuration, horizontally or at an angle, such that the edge of a protector received in a set of socket is aligned with the half-width point of an adjacently stacked protector for minimal crosstalk while conserving space. In an alternative embodiment, each row of the staggered, brick layering, configuration are spaced apart to further minimize crosstalk and may be suitable for even higher frequency applications.

14 Claims, 5 Drawing Sheets

PANEL FOR PLUG-IN PROTECTORS

FIELD OF THE INVENTION

The invention relates to a device for accommodating plug-in protectors operating at high frequencies with an optimal arrangement providing minimal interference between adjacent plug-in protectors.

BACKGROUND OF THE INVENTION

A building entrance protector, i.e. junction box, provides an interface for cables from the central office of the service provider for distribution to subscribers throughout the building served by the junction box. A typical building entrance protector contains a protector field and a plurality of connectors for interconnection. The protector field provides surge protection with five-pin plug-in protectors for each subscriber's line.

The protector field comprises a panel having sockets thereon for receiving plug-in protectors, which are solid state devices printed on wiring board. A typical protector field has a five by five grid configuration. Due to the need to conserve space within a junction box, the twenty-five plug-in protectors are placed abutting each other on the panel.

A typical five-pin plug-in protector has a rectangular box shape housing measuring ¾ inch wide, ½ inch high and 1⅝ inch long. Extending from one end of the protector are five terminals and from the opposite end is an integral tab handle having the height of the protector.

A typical plug-in protector has five terminals. Three of the five terminals are longer and are connected to the solid state surge protective device within the housing. The remaining two shorter terminals are for connection to the subscriber's line. Different length terminals allow a service technician to unplug the two shorter terminals while keeping the longer terminals in the sockets in order to service or discontinue service of a particular subscriber's line while safely maintaining surge protection on the line.

Typical plug-in protectors used for telephone lines in a prior art panel do not meet the high category (HiCAT) standard for crosstalk because the protectors are plugged closely adjacent to each other. Crosstalk is the undesirable signal from one protector that interferes with the signal of an adjacent protector caused by electromagnetic coupling. Crosstalk increases with higher frequencies. Therefore, a protector panel designed for lower frequency application is not suitable for high category frequency applications such as Category 3 (CAT3), Category 4 (CAT4) and Category 5 (CAT5) standards. Regular telephone lines fall within the Category 3 standard and the prior art panel may be used. However, such a prior art panel would not be suitable for protectors in the Category 5 standard, which has a critical (maximum) frequency of 100 megahertz (MHz).

Because crosstalk is caused by electromagnetic coupling, a direct enhancement in minimizing or eliminating crosstalk is to increase the distance between adjacent protectors. However, separation of adjacent protectors is space consuming and therefore expensive as each building entrance protector would accommodate less protectors, requiring additional building entrance protectors and space at the location.

Therefore, there is a need of a protector field panel that provides optimum positioning of five-pin plug-in protectors to minimize crosstalk between adjacent protectors while conserving space.

SUMMARY OF THE INVENTION

The invention provides a panel for plug-in protectors. The improved panel of the present invention provides an optimal arrangement of sockets for plug-in protectors to minimize crosstalk between adjacent plug-in protectors while conserving space. In particular, a panel for plug-in protectors in high frequency applications.

The panel of the present invention comprises a plurality of five-pin sockets, with each set of five-pin sockets corresponds to terminals of a five-pin plug-in protector. The plurality of sockets are arranged on the panel in a staggered, brick layering, configuration such that an edge of a protector received in a set of socket is aligned with the half-width point or the vertical axis of symmetry of an adjacently stacked protector. Such a configuration minimizes crosstalk over the prior art grid configuration while conserving space.

In an alternative embodiment, each row of the staggered, brick layering, configuration are spaced apart to further minimize crosstalk and may be suitable for higher frequency applications.

It will be appreciated that, for purposes of illustration, these figures are not necessarily drawn to scale.

DETAILED DESCRIPTION OF THE PREFERRED EMBODIMENTS

Figure 1:
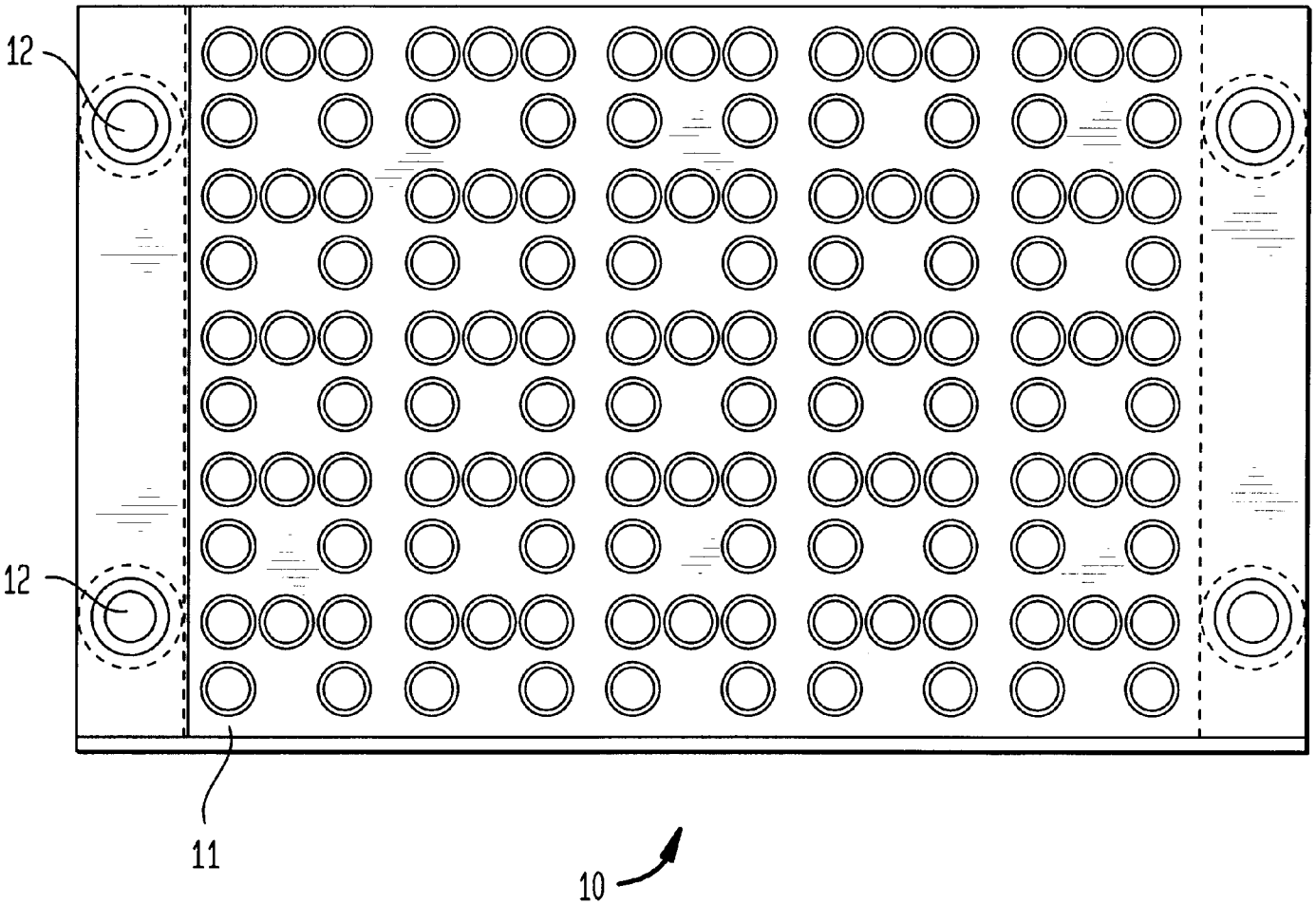
FIG. 1 (PRIOR ART)
FIG. 1 is a top plan view of a prior art five-by-five plug-in protector panel having a grid configuration.

With reference to the drawings, wherein the same reference number indicates the same element throughout, there is shown in FIG. 1 a top plan view of a prior art protector field panel 10 for five-pin plug-in protectors. Protector field panel 10 has a five-by-five grid configuration, with sockets 11 for twenty-five plug-in protectors. Panel 10 also provides holes 12 for mounting panel 10 in a junction box (not shown).

Figure 2:
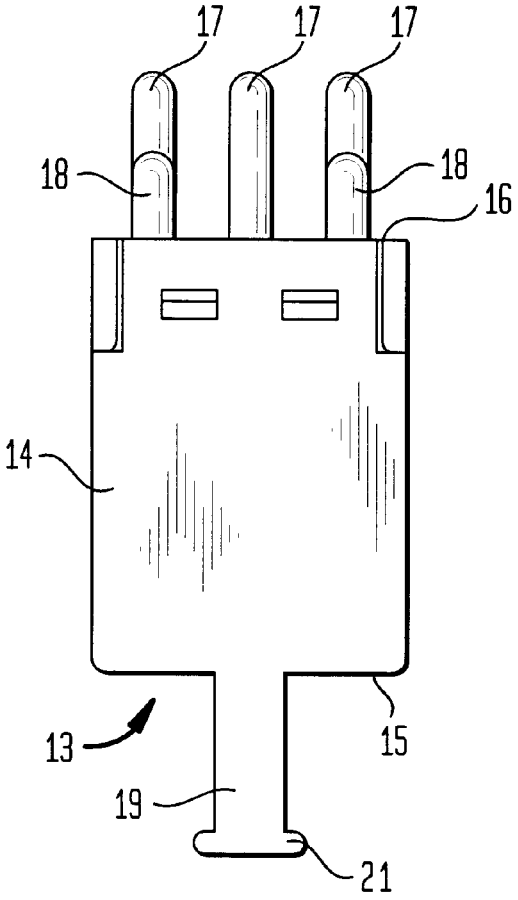
FIG. 2 is a side view a five-pin plug-in protector.
Figure 4:
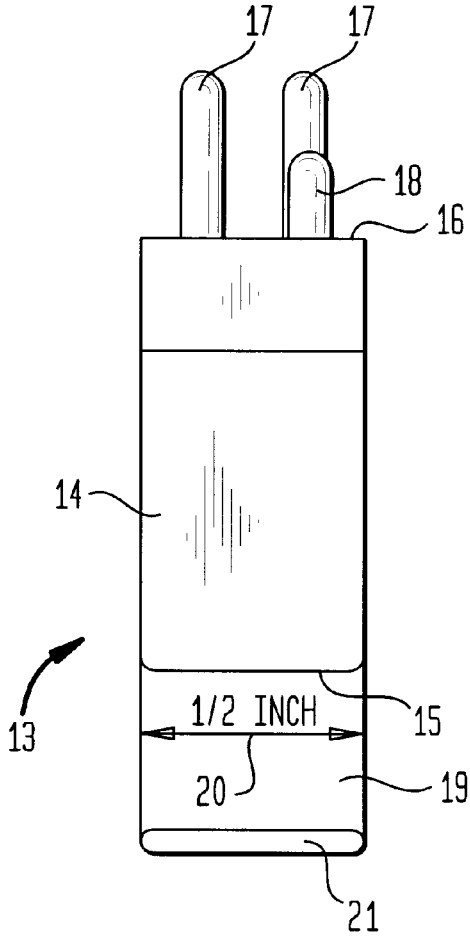
FIG. 4 is a top plan view of FIG. 2.
Figure 3:
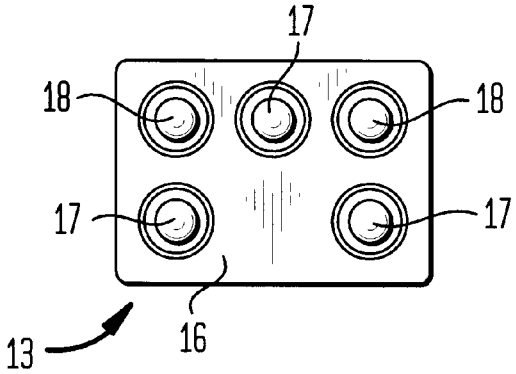
FIG. 3 is a rear elevational view of FIG. 2.

FIGS. 2–4 show a five-pin plug-in protector 13. Plug-in protector 13 comprises a rectangular shaped housing 14 having a front end 15 and a rear end 16. Extending from the rear end 16 are five terminals, three longer terminals 17 and two shorter terminals 18. The three longer terminals 17 are connected to a solid state surge protective device contained within housing 14 (not shown). The two shorter terminals 18 are for connection with an individual subscriber's line for surge protection. Extending from the front end 15 is a tab handle 19 having the same height 20 as the housing 14, typically ½ inch. At the end of tab handle 19 is a small ledge 21 that facilitates gripping of tab handle 19.

Figure 5:
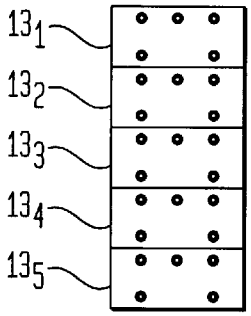
FIG. 5 (PRIOR ART)
FIG. 5 illustrates the relative positioning of a column of plug-in protectors in a prior art panel of FIG. 1.

FIG. 5 illustrates the positioning of a column of five plug-in protectors $\mathbf{13}_1$, $\mathbf{13}_2$ . . . $\mathbf{13}_5$ in the prior art panel 10. To conserve space within a junction box, a column of plug-in protectors 13 are stacked abutting each other on a prior art panel 10. The amount of crosstalk (C) is the largest when protectors 13 are stacked in alignment abutting each other in the grid configuration of prior art panel 10, as will be discussed in detail with reference to FIG. 10. Although rows of plug-in protectors 13 also closely abut each other (not shown), the interference between horizontally adjacent protectors 13 are relatively minimal in comparison with interference between vertically adjacent protectors 13.

Figure 6:
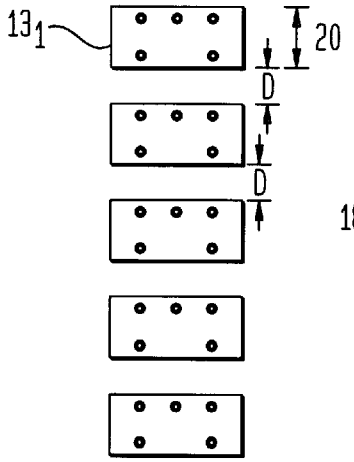
FIG. 6 illustrates the relative positioning of a column of plug-in protectors for minimal crosstalk.

A direct enhancement in minimizing crosstalk between a column of five plug-in protectors $\mathbf{13}_1$, $\mathbf{13}_2$ . . . $\mathbf{13}_5$ is to increase the distance between vertically adjacent protectors 13, as shown in FIG. 6. By separating vertically adjacent protectors 13 by a distance (D), the amount of crosstalk (C) can be minimized or even eliminated if sufficient distance is provided. However, the configuration shown in FIG. 6 disadvantageously take up more space and therefore more expensive.

Figure 7:
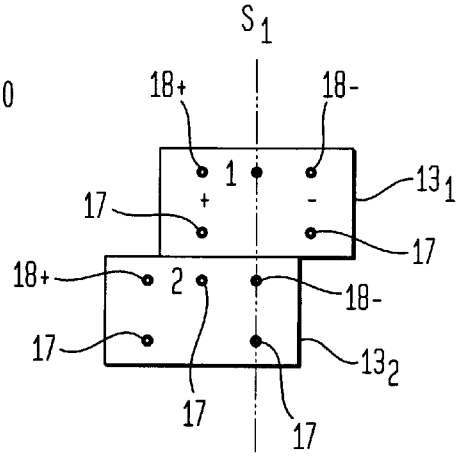
FIG. 7 illustrates the hypothetical relative positioning of two stacked plug-in protectors with minimum crosstalk.

FIG. 7 illustrates the hypothetical relative positioning of two adjacently stacked plug-in protectors $\mathbf{13}_1$, and $\mathbf{13}_2$ with minimum crosstalk. The two shorter terminals $\mathbf{18}_+$ and $\mathbf{18}_-$ form a pair of wires carrying alternating current. At the vertical axis of symmetry (S) of protector $\mathbf{13}_1$, $S_1$, the electromagnetic field generated by the alternating current in terminals $\mathbf{18}_+$ and $\mathbf{18}_-$ of protector $\mathbf{13}_1$, is balanced and vanishes. By aligning one of the terminals $\mathbf{18}_+$ and $\mathbf{18}_-$ of protector $\mathbf{13}_2$ with the vertical axis of symmetry $S_1$ of protector $\mathbf{13}_1$, as shown in FIG. 7, terminal $\mathbf{18}_-$ of protector $\mathbf{13}_2$ is not affected by the electromagnetic field generated by protector $\mathbf{13}_1$. Therefore, the amount of crosstalk (C) reaches a minimum for two adjacently stacked protectors $\mathbf{13}_1$ and $\mathbf{13}_2$ as shown in FIG. 7 in a hypothetical situation.

Figure 8:
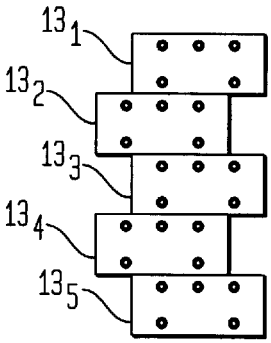
FIG. 8 illustrates the relative positioning of a column of plug-in protectors in the arrangement shown in FIG. 7.
Figure 9:
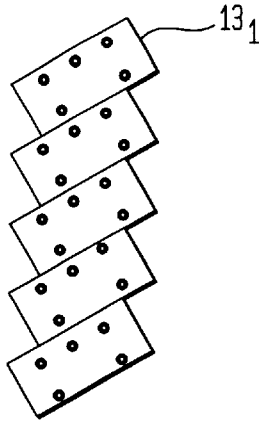
FIG. 9 illustrates the relative positioning of a column of plug-in protectors, similar to that shown in FIG. 8, having a zig-zag configuration.

FIGS. 8 and 9 illustrates the relative positioning of a column of five plug-in protectors $\mathbf{13}_1$, $\mathbf{13}_2$ . . . $\mathbf{13}_5$ utilizing the configuration shown in FIG. 7 for minimum crosstalk. FIG. 8 shows a staggered column of protectors 13. FIG. 9 shows a staggered column of protectors 13 at an angle having a zig-zag configuration. In comparison with FIG. 6, the configurations shown in FIGS. 8 and 9 advantageously conserve space by offseting adjacent protectors 13 in a column while minimizing crosstalk.

Due to the metal components contained in a protector 13, the electromagnetic field is not localized at the vertical axis of symmetry (S) as postulated in FIG. 7, but is distributed in a complex manner inside the housing 14. Measurements taken with a pair of Lucent's category 5 (CAT5) five-pin protectors 13 and a pair of shorted (dummy) five-pin protectors 13 illustrate the existence of a minimum amount of crosstalk (C) when two adjacently stacked protectors $\mathbf{13}_1$ and $\mathbf{13}_2$ are positioned offset relative to each other, as shown in FIG. 10.

Figure 10:
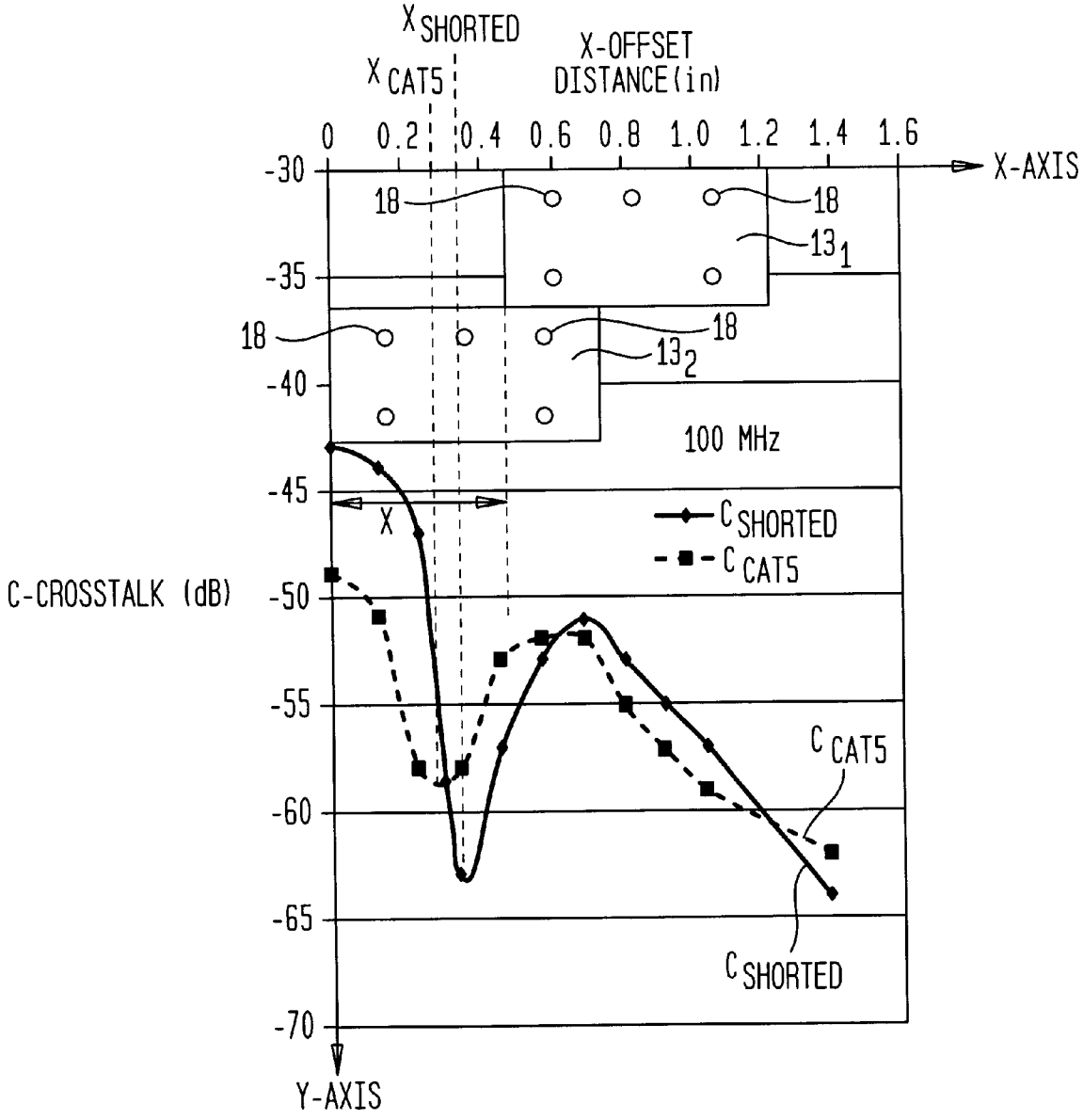
FIG. 10 is a graph illustrating the relation between the amount of crosstalk (Y-axis) and the offset distance (X-axis) between two adjacently stacked plug-in protectors.

The graph in FIG. 10 plots the amount of crosstalk (C) in decibel (dB) (Y-axis) as a function of the relative displacement or offset (X) in inches of two adjacently stacked protectors $\mathbf{13}_1$ and $\mathbf{13}_2$ (X-axis). Measurements are taken at 100 megahertz (MHz), which is the critical (maximum) frequency for category 5 (CAT5) protectors to illustrate the worst scenario for high frequency applications. The amount of crosstalk for CAT5 protectors is shown by the curve $C_{CAT5}$ and for the shorted protectors by curve $C_{shorted}$.

For both pairs of protectors $\mathbf{13}_1$ and $\mathbf{13}_2$, CAT5 and shorted, the maximum amount of crosstalk (C), −49 dB and −43 dB respectively, occur when the relative offset (X) is zero. Illustrating that the worst interference occurs when a pair of protectors are stacked in alignment directly over each other, as shown in FIG. 5, the configuration of prior art panel 10.

As the offset (X) increases between the pair of protectors $\mathbf{13}_1$ and $\mathbf{13}_2$, the amount of crosstalk (C) decreases because one of the terminals 18 is placed closer to the area where the electromagnetic field is smaller. Further increasing the offset (X) allows the two CAT5 protectors $\mathbf{13}_1$ and $\mathbf{13}_2$ to reach a minimum crosstalk of −58 dB at $X_{CAT5}$, approximately at 0.3 inch. Similarly, the two shorted protectors $\mathbf{13}_1$ and $\mathbf{13}_2$ reach a minimum crosstalk of −63 dB when the relative offset is at $X_{shorted}$, approximately 0.375 inch, which is half the width of the protector 13. Increasing the offset (X) further will again increase the amount of crosstalk (C) until the protectors are widely separated that no crosstalk exists, as suggested by FIG. 10.

As suggested by FIG. 10, minimum crosstalk (C) occurs when the relative offset (X) is at or very near half the width of an adjacently stacked protector 13. The amount of crosstalk for the pair of CAT5 protectors $\mathbf{13}_1$ and $\mathbf{13}_2$ at a relative offset (X) of half-width is −57 dB, only slightly higher than the minimum $C_{CAT5}$, at −58 dB. Although the results shown in FIG. 10 is tested with Lucent's five-pin protectors 13 at 100 MHz, results of other five-pin protectors 13 or at different frequencies is expected to similarly demonstrate a minimum amount of crosstalk (C) at or within approximately the range of ±20% from the half-width offset (X).

Further testing shows that for the configuration shown in FIG. 6 to have the same minimum amount of crosstalk for a pair of CAT5 protectors ($C_{CAT5}$), −58 dB, the distance (D) separating vertically adjacent protectors 13 must be increased to a distance of half the height 20 of the housing 14, i.e. ¼ inch. Therefore, a column of five protectors 13 with a total height of 2½ inches must increase to a total height (including D) of 3½ inches, a forty percent (40%) increase in space.

Figure 11:
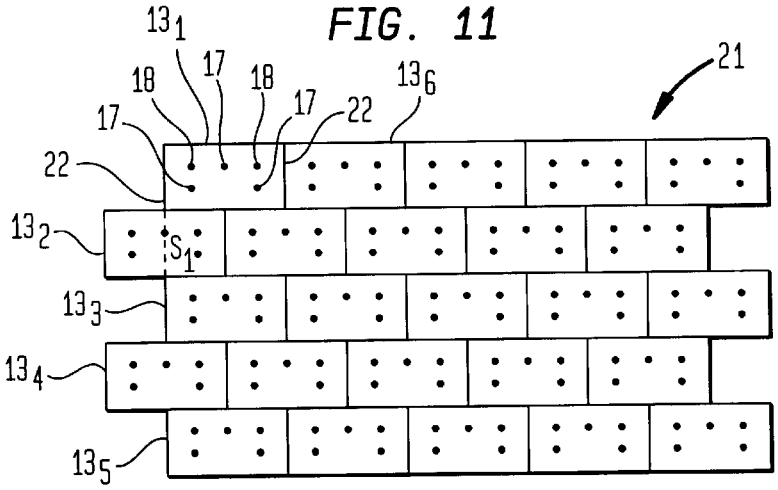
FIG. 11 illustrates a plug-in protector panel of the present invention having a brick layering configuration which minimizes crosstalk while conserving space.

FIG. 11 shows a panel of the present invention 21 with a plurality of protectors 13 plugged therein. Panel 21 has a plurality of sockets (not shown) corresponding to the five terminals 17 and 18 of each protector 13. Protectors 13 are arranged on the panel 21 in a staggered configuration similar to that shown in FIG. 8, but with an offset of half-width between two adjacently stacked protectors $\mathbf{13}_1$ and $\mathbf{13}_2$, creating a brick layering configuration. One of two opposite edges 22 of protector $\mathbf{13}_1$ is aligned with the half-width point at the vertical axis of symmetry $S_2$ of an adjacently stacked protector $\mathbf{13}_2$.

Figure 12:
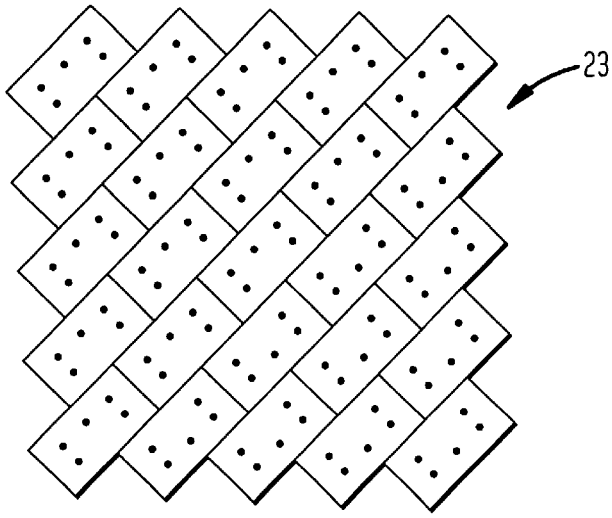
FIG. 12 illustrates the plug-in protector panel of FIG. 11 having a zig-zag configuration.

FIG. 12 shows another embodiment of the panel of the present invention 23 with a plurality of protectors 13 plugged therein. Protectors 13 are arranged on the panel 23 in a staggered and angled configuration similar to that shown in FIG. 9, but at a different angle and with an offset of half-width between adjacently stacked protectors $\mathbf{13}_1$ and $\mathbf{13}_2$, creating a zig-zag, brick layering configuration. As shown in FIGS. 9 and 12, the degree of the angle may vary, depending on the size and shape of the panel.

Figure 13:
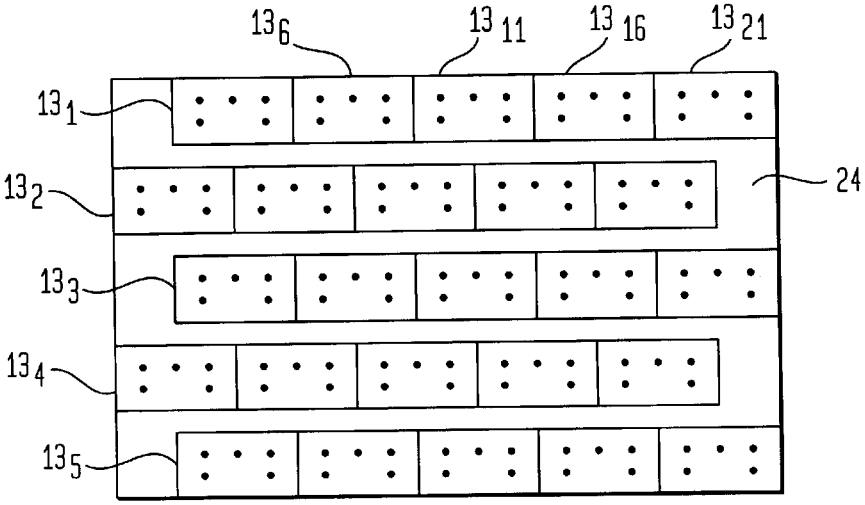
FIG. 13 illustrates another embodiment of the plug-in protector panel of the present invention having spaced apart rows which further minimizes crosstalk.

To further decrease the amount of crosstalk (C), FIG. 13 shows another embodiment of the panel of the present invention 24. Similar to panel 21 of FIG. 11, the plurality of protectors 13 are arranged in a staggered, brick layering configuration. However, each row of protectors, $\mathbf{13}_1$, $\mathbf{13}_6$ . . . $\mathbf{13}_{21}$ are spaced apart. The configuration of FIG. 12 can similarly have spaced apart diagonal rows of protectors 13 (not shown).

Although certain features of the invention have been illustrated and described herein, other better modifications and changes will occur to those skilled in the art. It is, therefore, to be understood that the appended claims are intended to cover all such modification and changes that fall within the spirit of the invention.

What we claim is:

1. A combination panel and protectors for space conservation and minimal crosstalk between adjacent protectors comprising at least two protectors, each protector having opposite edges defining a width and a half-width point equidistant from said opposite edges, and a panel comprising corresponding sets of sockets for receiving said protectors, said sets of sockets are arranged in a staggered, brick layering configuration such that at least one of the edges of each protector received therein is vertically aligned within a range of ±20% from the half-width point of an adjacently stacked protector such that minimal crosstalk exists between adjacently stacked protectors.

2. The panel according to claim 1 wherein said at least one of the edges of each protector adapted to be received in one of said sockets is vertically aligned with the half-width point of an adjacently stacked protector.

3. The panel according to claim 2 wherein said half-width point defines a vertical axis of symmetry of said adjacently stacked protector.

4. The panel according to claim 3 wherein said staggered, brick layering sets of sockets are arranged at an angle to form a zig-zag configuration.

5. The panel according to claim 4 wherein said sets of sockets are arranged in columns and rows.

6. The panel according to claim 5 wherein said rows of sockets spaced apart.

7. The panel according to claim 5 wherein said sets of sockets have a five-by-five configuration adapted to receive five protectors in a column and five protectors in a row.

8. A combination panel and high frequency five-pin plug-in protectors for space conservation and minimal crosstalk between adjacent protectors comprising at least two high frequency five pin plug-in protectors, each protector having opposite edges defining a width and a half-width point equidistant from the opposite edges, and a panel comprising corresponding sets of five-pin sockets for receiving said protectors, said sets of five-pin sockets are arranged in a staggered, brick layering configuration such that at least one of the edges of each protector received therein is vertically aligned within a range of ±20% from the half-width point of an adjacently stacked protector such that minimal crosstalk exists between adjacently stacked protectors.

9. The panel according to claim 8 wherein said at least one of the edges of each protector adapted to be received in one of said sockets is vertically aligned with the half-width point of an adjacently stacked protector.

10. The panel according to claim 9 wherein said half-width point defines a vertical axis of symmetry of said adjacently if stacked protector.

11. The panel according to claim 10 wherein said staggered, brick layering sets of sockets are arranged at an angle to form a zig-zag configuration.

12. The panel according to claim 11 wherein said sets of sockets are arranged in columns and rows.

13. The panel according to claim 12 wherein said rows of sockets are spaced apart.

14. The panel according to claim 12 wherein said sets of sockets have a five-by-five configuration adapted to receive five protectors in a column and five protectors in a row.

* * * * *